United States Patent [19]

Hümmler et al.

[11] 4,122,296

[45] Oct. 24, 1978

[54] DISTRIBUTING AND POKING MACHINE FOR METALLURGICAL FURNACES

[75] Inventors: Otto Hümmler, Siegen, Fed. Rep. of Germany; Bo Christer Welander, Ljungaverk, Sweden

[73] Assignees: Dango & Dienenthal, Siegen, Fed. Rep. of Germany; KemaNobel AB, Stockholm, Sweden

[21] Appl. No.: 799,612

[22] Filed: May 23, 1977

[30] Foreign Application Priority Data

May 21, 1976 [SE] Sweden ..... 7605823

[51] Int. Cl.[2] ..... F27D 23/02

[52] U.S. Cl. ..... 13/33; 214/32; 266/233; 366/261; 366/346

[58] Field of Search ..... 13/9, 33; 259/113; 266/233; 366/255, 261, 282, 273, 277, 601; 214/32

[56] References Cited

U.S. PATENT DOCUMENTS 3,258,256 6/1966 Brooke ..... 13/33 X 3,615,346 10/1971 Reth et al. ..... 13/9 X 3,679,806 7/1972 Reth et al. ..... 13/9

FOREIGN PATENT DOCUMENTS 2,340,104 2/1975 Fed. Rep. of Germany ..... 266/233

*Primary Examiner*—R. N. Envall, Jr.

*Attorney, Agent, or Firm*—Fred Philpitt

[57] ABSTRACT

An improved device for distributing and stirring the contents of a furnace having a plurality of vertically disposed electrodes, said improved device including a circular track disposed adjacent the upper periphery of said furnace, a first transport carriage, motor means for moving said first transport carriage, an elongated non-circular trackway supported by said first transport carriage, a second transport carriage, a non-circular trackway, means to move said second transport carriage back and forth, a furnace contents working device connected to said second transport carriage, and means to vary the angular disposition of said furnace contents working device.

8 Claims, 3 Drawing Figures

DISTRIBUTING AND POKING MACHINE FOR METALLURGICAL FURNACES

BACKGROUND

In preparation of metallurgical products, which are molten in open or partly closed furnaces, it is necessary to be able to (1) distribute the raw material correctly in accordance with the furnace process, (2) crush the contact bridges between the separate electrodes, and (3) pierce the gas-filled cavities formed and to fill them again.

These operations must be carried out to make possible a continuous melting process and in addition, this process must be as economical as possible.

In the working processes so far known these operations are performed with the aid of mobile or partly mobile means, which in addition to the charging of raw materials, also have distributing and stirring functions. Such means are operated by an operator travelling on the machine who is thus exposed to the very unfavorable aspects of the furnace environment.

The high temperature and the gases from the furnace prevent the operator from doing his work effectively, and moreover, they have a direct detrimental effect on him. The machines can also be damaged if they are exposed to a high temperature for a long time, and therefore working cannot, as a rule, take place continuously. Furthermore, stirring machines are known which are mounted at several places around the furnace and by means of which a definite section of the furnace surface can be worked under the control of an operator.

In addition to the unfavorable working conditions these stirring machines have the disadvantage that a large portion of the charging platform cannot be used for other necessary operations. With the development of big furnace units this work has become more and more dangerous and intolerable for man and machine. At these furnaces charging of the raw material is substantially carried out through pipes in the furnace cover.

It is extremely difficult to handle the mobile machines under unfavorable conditions. The least negligence by the attendant may damage the very expensive furnace equipment and the machine.

The problems are especially difficult when furnaces containing electrodes are concerned. The latter must not be damaged when the charge in the vicinity thereof is worked. The electrodes will thus complicate the access to certain parts of the charge surface. Moreover, there is a risk of a flash-over between the furnace and the machine. The present invention is especially suitable for solving these problems, and therefore it is preferred that the present invention be utilized in electric arc furnaces and reduction furnaces of the aforesaid kind.

These difficulties with prior art devices are avoided by the present invention and an effective working of the charge surface is made possible without the operating staff and the material being exposed to the detrimental effects of the furnace environment.

THE PRESENT INVENTION

Considered from one aspect, the present invention involves an improved device for distributing and stirring the contents of a furnace having a plurality of vertically disposed electrodes, said improved device including (a) a circular track disposed adjacent the upper periphery or perimeter of said furnace, (b) a first transport carriage that is supported by said circular track, (c) motor means for moving said first transport carriage from one position to another in said circular track, (d) an elongated non-circular trackway supported by said first transport carriage, said non-circular trackway extending in a generally radial direction with respect to said circular track, (e) a second transport carriage supported by said elongated non-circular trackway, (f) means to move said second transport carriage back and forth within said elongated non-circular trackway, (g) a furnace contents working device connected to said second transport carriage, and (h) means to vary the angular disposition of said furnace contents working device.

An illustrative example of the invention is shown in the enclosed drawings, wherein FIG. 1 is a top view of a furnace, a distributing and stirring machine in accordance with this invention;

Figure 1:
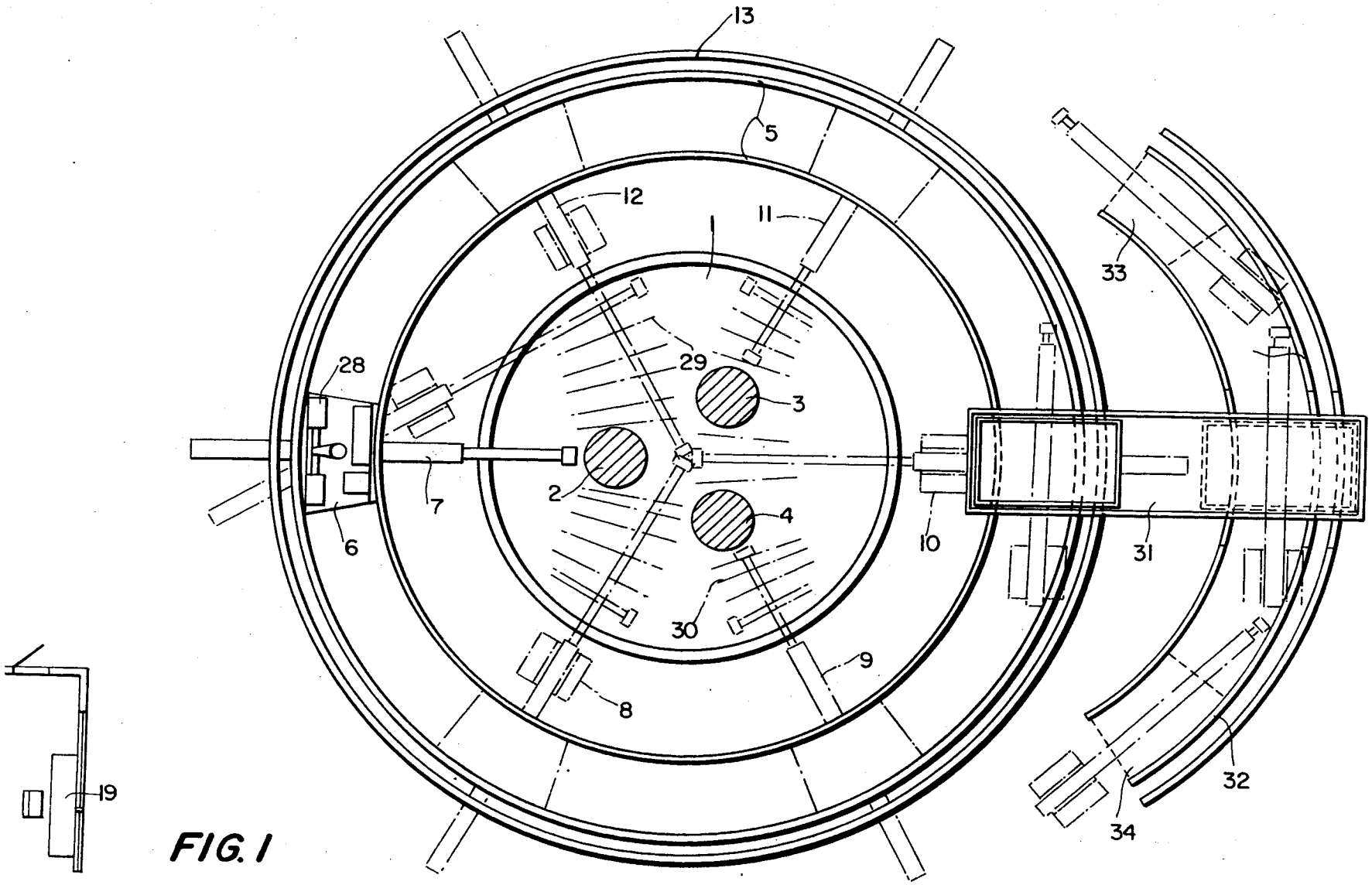

The track 5 is preferably circular and is arranged around the upper perimeter of the furnace 1. The track 5 may suitably be attached to the ceiling above the furnace since this eliminates the need for ground supports that might interfere with the functioning of the furnace. The furnace 1 is shown as having a plurality of vertical electrodes 2, 3 and 4.

A first transport carriage 20 is supported by the track 5. Wheels 15 on the transport carriage 20 permit the carriage to move to various positions, as indicated by the numbers 7, 8, 9, 10, 11 and 12.

Any suitable motor means may be utilized to cause the first transport carriage to move from one position to another in said circular track. If the motor means is electrical a power lead from the motor to an annularly arranged power track 13 works quite well. Said first transport carriage can be locked in any of the aforesaid working positions 7–12 by means of bolts or dogs 14 that are adapted to engage the track 5.

A control connection 18 to a remote control stand 19 is established by means of contacts 17 mounted in fittings 16.

An elongated non-circular trackway 21 is mounted beneath said first transport carriage 20. As is indicated in FIG. 1, trackway 21 ordinarily extends in a generally radial direction with respect to the circular track. However, trackway 21 is suspended from the first transport carriage by a swivel connection so that when swivel arm 28 is actuated the trackway 21 can be caused to move through a limited arc about the point of swiveling (as indicated in FIG. 1).

Figure 2:
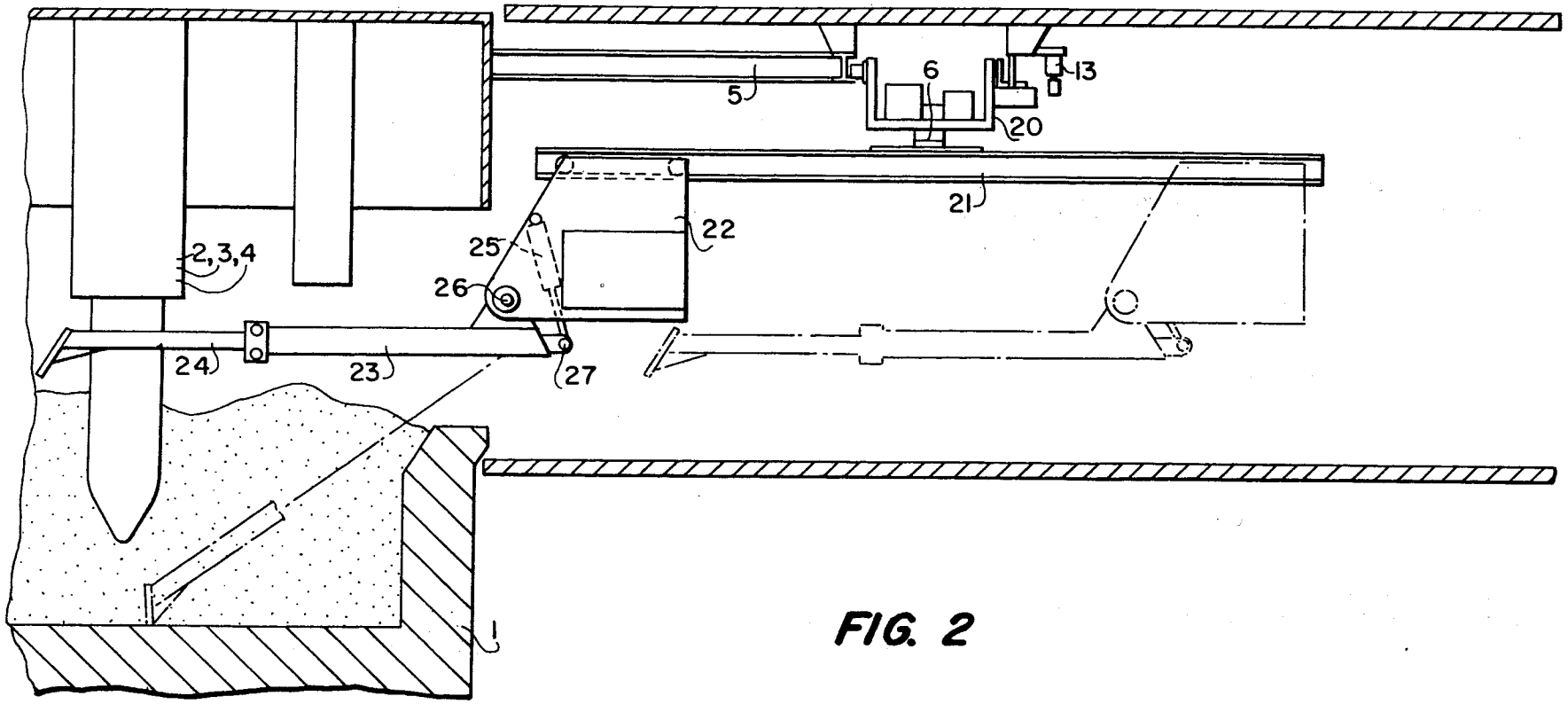
FIG. 2 is a side view of the distributing and stirring machine.
Figure 3:
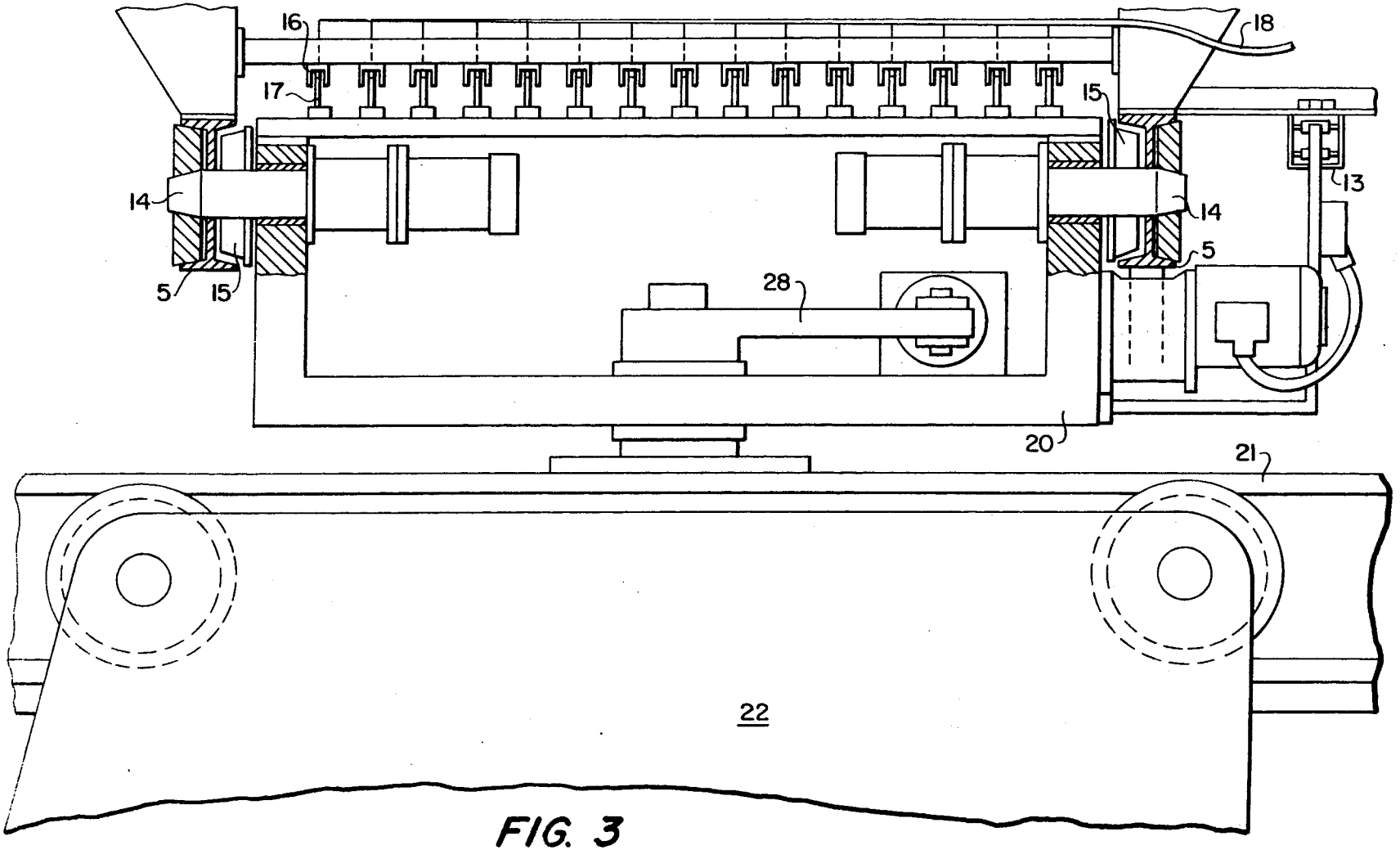
FIG. 3 is a cross section of the transport carriage.

A second transport carriage 22 is supported by the trackway 21 and is adapted to move back and forth along trackway 21 (as indicated by the phantom position shown in FIG. 2) by any suitable motor means.

A furnace contents working device or tool 23 is pivotally mounted adjacent the end of said second transport carriage 22 by a pivotal mounting bar 26. When a hydraulic cylinder 25 is connected to the end 27 of tool 23 and the carriage 22, the hydraulic cylinder can cause tool 23 to move in an up and down direction (as indicated by the phantom lines in the furnace 1 of FIG. 2). The tool 23 preferably has a replaceable end portion 24. Pivotable connections 26 and 27 are preferably insulated against the extreme heat, dust, etc.

The various possible operating movements such as "Drive to Operating Position," "Locking the Transport Carriage," "Turning the Control Arm with the Stirring Carriage," "Forward and Backward Movement of the Stirring Carriage" as well as "Lifting and Lowering the Distribution and Stirring Plate" can be activated from a remote control station 19 in a simple as well as programmed control.

By establishing separate adjustable working patterns limitations for the tool 23 at each of the positions 7–12, the limit curves 29 or 30 (see FIG. 1) will not be exceeded and thereby all parts of the furnace will be protected from collisions.

When repairs become necessary, the carriage 22 or the carriage 20 can be shifted to an outer track 32 with the aid of a switching means 31. There the carriage 22 or the carriage 20 can be moved into repair position 33. Switching means 31 also permits a replacement carriage 34 to be run onto the track 5 or the trackway 21.

It is thus seen that the present invention permits movements of the tool 23 in the X-, Y- and Z- directions.

Our device can be easily provided with the equipment for remote control so that the operating staff can effectively control the charge working from a safe and comfortable place. Therefore the device is preferably remote controlled.

Thanks to the fact that working can be carried out from a suitable position chosen in advance, almost the whole charge surface will be available for working and the working processes can be more easily remote controlled.

Another advantage of our invention is that since the machine can be driven on high crane rails, a greater angle of inclination for the arm 23 can be obtained. Only by our device it is possible to work the surface of the ore mixture close to the furnace edge without the risk of damaging important furnace parts and the machine. Furthermore, the stirring rod 24 can penetrate deeper into the furnace than is possible with machines arranged on the floor.

These objects are best achieved if the point of attachment of the stirring arm 23 is always above the furnace edge in operation. This point of attachment is preferably placed in the range between 0.3 and 3 m above the furnace edge, and most preferably between 1 and 2 m.

Access is easier if the point of attachment moves in working on a horizontal plane within the range $\frac{1}{4}$ D into the furnace from the furnace edge to 1 D from the furnace edge or, preferably, within the range between $\frac{1}{8}$ D inwards to $\frac{1}{2}$ D outwards, D being the diameter of the furnace.

A device placed high is also advantageous because the managing space of the furnace will be free for other operations and the device consequently will be protected against objects, soiling and furnace dust on the floor. This is best achieved if the device is arranged in a hanging rather than in an upright position. The space between the track and the managing floor is preferably 1.5 to 5 m and preferably between 2 and 4 m.

A safe remote control without knocking against and destroying important parts is obtained due to the fact that the machine can be operably moved on a track about the furnace to various working positions. There the machine is mechanically locked with the track preferably at especially arranged stations. Out of these fixed positions the machine can perform the operations described above with a suitable stirring and distributing tool, said tool being moved backwards and forwards, turned to the right and to the left and lifted and lowered.

All movements are carried out operably through selected hydraulic, pneumatic or electromechanical operation within motion spaces, the different sizes of which are adapted in known manner to the various working positions.

Our machine can work a definite section of the furnace in the different working positions, which are fixed relative to the arrangement of the electrodes and the feed pipes, and consequently work the whole furnace surface by being adjusted into different positions.

At remote control the transmission of signals can take place via a cable or another direct contact between the control station and the device or wireless by means of radio or ultrasonic signals.

The moving capability of the machine on the positioning track is arranged so that it can be moved away from the furnace zone, if necessary, either to make the surroundings of the furnace free for other important operations or to be able to carry out repairs on the machine in a safe position. However, a reserve machine can be driven into the positioning track, which takes over the works in the furnace during the time of repair. In order to avoid a direct electric flash-over from the furnace to our machine, the support for the replaceable distributor 24 and stirring member 23 is connected via electrically insulated sleeves to the rest of the machine.

In conclusion, while the foregoing specification and drawing describe the construction, operation and use of one preferred embodiment of the instant invention, it is to be understood that we do not intend to limit ourselves to the precise constructions and arrangements herein disclosed, since the various details of construction, form and arrangement may obviously be varied to a considerable extent by anyone skilled in the art without really departing from the basic principles and novel teachings of this invention and without sacrificing any of the advantages of the invention, and accordingly, it is intended to encompass all changes, variations, modifications and equivalents falling within the scope of the appended claims.

We claim:

1. In the known combination of (1) a furnace, (2) a plurality of vertical electrodes, and (3) a mechanism for distributing and stirring the contents of said furnace, the improvement consisting of a distributing and stirring mechanism that includes in combination, (a) a circular track disposed adjacent the upper perimeter of said furnace, (b) a first transport carriage that is supported by said circular track, (c) motor means for moving said first transport carriage from one position to another in said circular track (d) an elongated non-circular trackway supported by said first transport carriage, said non-circular trackway extending in a generally radial direction with respect to said circular track, (e) a second transport carriage supported by said elongated non-circular trackway, (f) means to move said second transport carriage back and forth within said elongated non-circular trackway, (g) a furnace contents working device connected to said second transport carriage, and (h) means to vary the angular disposition of said furnace contents working device.

2. The mechanism of claim 1 wherein said second elongated non-circular trackway is connected to said first transport carriage by a swivel mounting so that the end of said trackway can move thru a limited arc.

3. A mechanism according to claim 1 which includes means to lock said first transport carriage in any one of several positions around said circular track.

4. A mechanism according to claim 1 which additionally includes switch means to convey either of said carriages to a third track where said carriage can be repaired or conveyed to another area for repair.

5. A mechanism according to claim 1 which includes remote control means for remotely controlling the movement of at least one of (1) said first transport carriage (2) said second carriage and (3) said furnace contents working device.

6. A mechanism according to claim 5 characterized in that the first transport carriage automatically enters electrical contacts (16, 17) when entering the various working positions (17–12) said contacts being connected with a remote control station from which the various movements of the unit can be controlled.

7. The mechanism according to claim 1 which contains insulating means which prevent electrical contact between the furnace parts and earth.

8. The device claim 7 characterized in that the furnace contents working device (23, 24) is attached to the carriage (22) via electrical insulators.

* * * * *